US006941607B1

(12) United States Patent
Berglass

(10) Patent No.: US 6,941,607 B1
(45) Date of Patent: Sep. 13, 2005

(54) JEWELRY TOOTHBRUSH

(76) Inventor: Michael E Berglass, 166 Shore Rd., Port Washington, NY (US) 11050

( * ) Notice: Subject to any disclaimer, the term of this patent is extended or adjusted under 35 U.S.C. 154(b) by 79 days.

(21) Appl. No.: 10/348,529

(22) Filed: Jan. 20, 2003

(51) Int. Cl.[7] ..... A46B 5/02; A46B 9/04

(52) U.S. Cl. ..... 15/167.1; 15/143.1; 15/184; D4/129

(58) Field of Search ..... 15/143.1, 167.1, 15/184, 227; D4/108, 113, 129

(56) References Cited

U.S. PATENT DOCUMENTS

| | | | | | |
|---|---|---|---|---|---|
| 949,587 | A | | 2/1910 | Ludington | |
| 1,142,356 | A | | 6/1915 | Hellany | |
| 1,470,710 | A | | 10/1923 | Davis | |
| 1,646,848 | A | * | 10/1927 | Peabody | 132/73.5 |
| 2,083,728 | A | | 6/1937 | Mayer | |
| D150,655 | S | * | 8/1948 | Reinecke | D11/2 |
| 2,454,995 | A | | 11/1948 | Curran | |
| 2,505,547 | A | | 4/1950 | Howard | |
| 3,214,776 | A | | 11/1965 | Bercovitz | |
| 3,798,698 | A | | 3/1974 | Conklin, Jr. | |
| 4,654,921 | A | | 4/1987 | Dinner | |
| 4,850,074 | A | | 7/1989 | Klevan | |
| 4,979,258 | A | | 12/1990 | Buj | |
| 5,287,584 | A | | 2/1994 | Skinner | |
| 5,615,441 | A | * | 4/1997 | Savini | 15/111 |
| 5,735,298 | A | | 4/1998 | Mayne et al. | |
| 5,968,309 | A | | 10/1999 | Tarr | |
| 5,979,005 | A | | 11/1999 | Lecce | |
| 6,116,252 | A | * | 9/2000 | Stelmach | 132/309 |
| 2002/0144702 | A1 | * | 10/2002 | Gueret | 132/294 |

FOREIGN PATENT DOCUMENTS

| | | | |
|---|---|---|---|
| GB | 2 185 930 | * | 8/1987 |

* cited by examiner

*Primary Examiner*—Randall Chin
(74) *Attorney, Agent, or Firm*—Michael I. Kroll

(57) ABSTRACT

The present invention 10 discloses a multipurpose device comprising two half-elliptical shaped members 16, 18 forming a wrist bracelet that are pivotally attached by a hinge member 26. Located at one end 16 from the hinge 26 is a toothbrush 24. Located at the opposite distal end from the hinge 26 is a sanitary housing 20 for the storage of the brush 24 when not in use. This also forms the closure of the device forming the bracelet 28 shape. The housing chamber portion 20 has a multipurpose door 22 that provides a sanitary seal, locking out contamination and also provides closure for the toothbrush portion 24 of the device. When the device is ready to be used, the sanitary door 22 is lifted up and the brush portion 24 is removed from the chamber 20. Other alternate forms of the present invention 10 include a toothbrush ring 30 that children can wear on their finger 32. The toothbrush ring of the present invention 10 provides a sanitary cover 20 that snaps on and off of the housing base 34 as required by the user.

10 Claims, 10 Drawing Sheets

JEWELRY TOOTHBRUSH

BACKGROUND OF THE INVENTION

1. Field of the Invention

The present invention relates generally to toothbrushes and, more specifically, to a novelty bracelet designed for children to wear on their wrists and has several advantages; dentists are constantly reminding their patients to brush after every meal. This is a difficult task for children in school or away at camp. Many are embarrassed to remove a toothbrush from their knapsack and many, become consumed with their activities and forget to brush. The present invention overcomes these problems by providing a jewelry bracelet that incorporates a toothbrush that a child would wear on their wrist. The bracelet looks cool and is a great reminder to brush after each meal.

The toothbrush of the present invention is a multipurpose device comprising two half-elliptical shaped members that are pivotally attached by a hinge member. Located at one end from the hinge is a toothbrush. Located at the opposite distal end from the hinge is a sanitary housing for the storage of the brush when not in use. This also forms the closure of the device forming the bracelet shape.

The housing chamber portion has a multipurpose door that provides a sanitary seal, locking out contamination and also provides closure for the toothbrush portion of the device. When the device is ready to be used, the sanitary door is lifted up and the brush portion is removed from the chamber.

Other alternate forms of the present invention include a toothbrush ring that children can wear on their finger. The toothbrush ring of the present invention provides a sanitary cover that snaps on and off of the toothbrush housing as required by the user.

2. Description of the Prior Art

There are other novelty toothbrush devices designed for the purpose mentioned herein. Typical of these is U.S. Pat. No. 949,587 issued to Ludington on Feb. 15, 1910.

Another patent was issued to Nellany on Jun. 8, 1915 as U.S. Pat. No. 1,142,356. Yet another U.S. Pat. No. 1,470,710 was issued to Davis on Oct. 16, 1923 and still yet another was issued on Jun. 15, 1937 to Mayer as U.S. Pat. No. 2,083,728.

Another patent was issued to Curran on Nov. 30, 1948 as U.S. Pat. No. 2,454,995. Yet another U.S. Pat. No. 2,505,547 was issued to Howard on Apr. 25, 1950. Another was issued to Bercovitz on Nov. 2, 1965 as U.S. Pat. No. 3,214,776 and still yet another was issued on Mar. 26, 1974 to Conklin Jr. as U.S. Pat. No. 3,798,698.

Another patent was issued to Dinner on Apr. 7, 1987 as U.S. Pat. No. 4,654,921. Yet another U.S. Pat. No. 4,850,074 was issued to Klevan on Jul. 25, 1989. Another was issued to Buj on Dec. 25, 1990 as U.S. Pat. No. 4,979,258 and still yet another was issued on Feb. 22, 1994 to Skinner as U.S. Pat. No. 5,287,584.

Another patent was issued to Mayne et al. on Apr. 7, 1998 as U.S. Pat. No. 5,735,298. Yet another U.S. Pat. No. 5,968,309 was issued to Tarr on October 19, 1999. Another was issued to Lecce on Nov. 9, 1999 as U.S. Pat. No. 5,979,005 and still yet another was issued on Sep. 12, 2000 to Stelmach as U.S. Pat. No. 6,116,252.

U.S. Pat. No. 949,587

Inventor: Raymond Ludington

Issued: Feb. 15, 1910

This invention discloses a toothbrush. A handle pivoted to the brush, and a housing hingedly connected to the handle adapted to encase the brush and handle when the latter are in a folded position.

U.S. Pat. No. 1,142,356

Inventor: Charles V. Nellany

Issued: Jun. 8, 1915

This invention contemplates a toothbrush provided with a casing or compartment adapted to contain the bristles when not in use and forming part of the brush as an entirety.

U.S. Pat. No. 1,470,710

Inventor: Lawrence Davis

Issued: Oct. 16, 1923

The invention relates to instruments which are employed for the purpose of removing deposits of foreign matter from the surfaces of various objects, and especially relates to brushes which are used for the cleaning of teeth.

U.S. Pat. No. 2,083,728

Inventor: Harry Mayer

Issued: Jun. 15, 1937

The object of this invention is to produce a collapsible toothbrush which, when extended, will be adequately large and rigid for its intended purpose but which can be folded into a small space to be carried in a pocket or purse.

U.S. Pat. No. 2,454,995

Inventor: Elwood Curran

Issued: Nov. 30, 1948

The invention relates to disposable toothbrush cleaning kit and its object is to contribute to the comfort and convenience of the public in general.

U.S. Pat. No. 2,505,547

Inventor: Frances Howard

Issued: Apr. 25, 1950

This invention relates to toothbrushes and more particularly to a combined foldable toothbrush and powdered dentifrice dispenser.

U.S. Pat. No. 3,214,776

Inventor: Louis Bercovitz

Issued: Nov. 2, 1965

The invention relates to a hand actuated oscillatable mechanical brush, and is specially applicable to toothbrushes.

U.S. Pat. No. 3,798,698

Inventor: Carroll Conklin Jr.

Issued: Mar. 26, 1974

A disposable tooth cleaner of the type that includes integrally formed fastening means for attaching the device to a users finger in the form of two oppositely extending strip portions one which is provided with integrally molded protrusion means, said protrusion being adapted to snap into locked engagement with said hole means at various positions of adjustment when the strip portions are wrapped around the user's finger.

U.S. Pat. No. 4,654,921

Inventor: Mark Dinner

Issued: Apr. 7, 1987

A toothbrush comprised of a handle including an oval ring that defines an oval aperture sized for the passage therethrough of a young child's or infant's four fingers for fist gripping a half portion of the oval ring; and a brush head including an array of bristles that extends in general alignment with the major axis of the oval ring.

U.S. Pat. No. 4,850,074

Inventor: Stewart Klevan

Issued: Jul. 25, 1989

A folding toothbrush having an articulated handle with a front portion, a center portion and a back portion. Bristles are attached to the front end of the front portion. The handle portions are joined by hinges such that the toothbrush can be stored in a folded configuration and can be opened to an operational configuration in which the handle portions are longitudinally aligned. The toothbrush is preferably made of a plastic material so that the handle can be molded as a single piece with "living" hinges. The center portion of the handle interlocks with the front and back portions when the handle is fully extended so that it will remain in its operational configuration while in use.

U.S. Pat. No. 4,979,258

Inventor: Elena Buj

Issued: Dec. 25, 1990

A children's toothbrush having a handle and an arm joined to the handle and having bristles disposed at one end thereof. A joint is formed on the opposite end of the arm for connection to the handle. The handle has a cavity for receiving the arm and the bristles therein when the toothbrush is folded. There is also a lock disposed in the joint for releasably locking the joint to maintain said toothbrush in an open position. The joint comprises a cylindrical portion formed on the end of the arm having a central pivot hole. An annular channel is formed around the pivot hole and spaced-apart wing arms receiving and capturing the cylindrical portion to complete the joint.

U.S. Pat. No. 5,287,584

Inventor: John Skinner

Issued: Feb. 22, 1994

This invention relates to a novel finger toothbrush. More particularly, this invention pertains to a unique toothbrush which can fit on a finger of a user for brushing the teeth of the user or the teeth of other human being or animal. The invention comprises a base portion with a plurality of bristles secured in and protruding from the base. A first curved finger gripping device extends from a first side of the base away from the bristles with a second curved finger gripping device extending from a second side of the base away from the bristles. Friction enhancing devices are formed in the interior facing surfaces of the first and second finger gripping device.

U.S. Pat. No. 5,735,298

Inventor: Harlo Mayne et al.

Issued: Apr. 7, 1998

A tri-fold multipurpose toothbrush (14) which comprises a component (16) for cleaning teeth. An arm assembly (18) is provided. A unit (20) on a first end of the arm assembly (18) is for retaining the teeth cleaning components (16) thereto in a removable manner. A case (22) is also provided. A member (24) at a second end of the arm assembly (18) is for pivoting the arm assembly (18) on a first end of the case (22). The arm assembly (18) with the teeth cleaning component (16) can fold down upon the case (22) when not in use and can fold out from the case (22) when in use. An assemblage (26) is for locking the arm assembly (18) in any angle when folded out from the case (22). A handle (28) is also provided, having a recessed area (30). Another member (32) at a first end of the handle (28) is for pivoting the handle (28) on a second end of the case (22). The handle (28) can fold down upon the case (22) with the recessed area (30) over the arm assembly (18) with the teeth cleaning component (16) when not in use. The handle (28) can fold out from the case (22) to be gripped by a hand of a person when in use.

U.S. Pat. No. 5,968,309

Inventor: Daniel Tarr

Issued: Oct. 19, 1999

A method to transform a thermoplastic novelty toothbrush into a costume jewelry piece, such as a bracelet, or a toy after it is no longer employed in service as a toothbrush. The thermoplastic material allows a user to easily remove the bristles and form the toothbrush into a costume jewelry piece or toy.

U.S. Pat. No. 5,979,005

Inventor: Frank Lecce

Issued: Nov. 9, 1999

A toothbrush having a curvilinear open loop shaped handle that extends through an arc of approximately 270 degrees. The handle of this toothbrush also includes a head disposed at one end thereof. The head has a plurality of bristles extending radially outwardly from the center of said open loop shape handle. In some forms of the invention the toothbrush is dimensioned and configured such that an imaginary square having all sides equal extends around the toothbrush will substantially abut the free end of the bristles on one side thereof and portions of the curvilinear handle on the other three sides of said imaginary square.

U.S. Pat. No. 6,116,252

Inventor: John J. Stelmach

Issued: Sep. 12, 2000

A finger-mounted disposable toothbrush including a lanyard of dental floss, a first end of which is attached to the toothbrush and a second end of which is looped around the user's wrist. The dental floss lanyard prevents swallowing of the toothbrush during use and can also be used for flossing the user's teeth after brushing. The disposable toothbrush further comprises a mounting ring that fits over the user's finger. The mounting ring is affixed to the topside of a bristle base. Tooth cleaning bristles are attached to the bottom side of the bristle base and are optionally impregnated with dental paste or powder. Bumps can be molded in those areas of the bristle base and mounting ring with which the user's finger comes in contact, said bumps enhancing the user's grip on the toothbrush.

While these novelty toothbrushes may be suitable for the purposes for which they were designed, they would not be as suitable for the purposes of the present invention, as hereinafter described. A novelty bracelet designed for children to wear on their wrists comprising two half, elliptical shaped members that are pivotally attached by a hinge member. Located at the opposite end from the hinge portion of the first half, comprises a toothbrush member fixedly attached to the housing. Located at the opposite distal end from the hinge portion of the second half, a sanitary housing, comprising a chamber, whereby the brush portion of the first half is housed within when not in use. This also forms the closure of the device forming the bracelet shape. The chamber portion comprises a multipurpose door that provides a sanitary seal, locking out contamination and also provides closure to the toothbrush portion of the device. When the device is ready to be used, the sanitary door is lifted up and the bracelet portion is removed from the chamber.

SUMMARY OF THE PRESENT INVENTION

The present invention discloses a multipurpose device comprising two half-elliptical shaped members forming a wrist bracelet that are pivotally attached by a hinge member. Located at one end from the hinge is a toothbrush. Located at the opposite distal end from the hinge is a sanitary housing for the storage of the brush when not in use. This also forms the closure of the device forming the bracelet shape. The housing chamber portion has a multipurpose door that provides a sanitary seal, locking out contamination and also provides closure for the toothbrush portion of the device. When the device is ready to be used, the sanitary door is lifted up and the brush portion is removed from the chamber. Other alternate forms of the present invention include a toothbrush ring that children can wear on their finger. The toothbrush ring of the present invention provides a sanitary cover that snaps on and off of the housing base as required by the user.

A primary object of the present invention is to provide a novelty toothbrush that is designed for children to wear on their wrists.

Another object of the present invention is to provide a novelty toothbrush that provides a jewelry bracelet that incorporates a toothbrush whereby a child would wear on the wrist portion of the body.

Yet another object of the present invention is to provide a novelty toothbrush that looks cool and is a great reminder to brush after each meal.

Still yet another object of the present invention is to provide a novelty toothbrush that is a multipurpose device comprising two half, elliptical shaped members that are pivotally attached by a hinge member.

Another object of the present invention is to provide a novelty toothbrush that at the opposite end from the hinge portion of the first half, comprises a toothbrush member fixedly attached to the housing.

Yet another object of the present invention is to provide a novelty toothbrush that at the opposite distal end from the hinge portion of the second half, a sanitary housing, comprising a chamber, whereby the brush portion of the first half is housed within when not in use. This also forms the closure of the device forming the bracelet shape.

Still yet another object of the present invention is to provide a novelty toothbrush that the chamber portion comprises a multipurpose door that provides a sanitary seal, locking out contamination and also provides closure to the toothbrush portion of the device.

Additional objects of the present invention will appear as the description proceeds.

The present invention overcomes the shortcomings of the prior art by providing a novelty bracelet designed for children to wear on their wrists comprising two half, elliptical shaped members that are pivotally attached by a hinge member. Located at the opposite end from the hinge portion of the first half, comprises a toothbrush member fixedly attached to the housing. Located at the opposite distal end from the hinge portion of the second half is a sanitary housing, comprising a chamber, whereby the brush portion of the first half is housed within when not in use. This also forms the closure of the device forming the bracelet shape. The chamber portion comprises a multipurpose door that provides a sanitary seal, locking out contamination and also provides closure to the toothbrush portion of the device. When the device is ready to be used, the sanitary door is lifted up and the bracelet portion is removed from the chamber.

The foregoing and other objects and advantages will appear from the description to follow. In the description reference is made to the accompanying drawings, which form a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWINGS

In order that the invention may be more fully understood, it will now be described, by way of example, with reference to the accompanying drawings in which.

LIST OF REFERENCE NUMERALS

Figure 1:
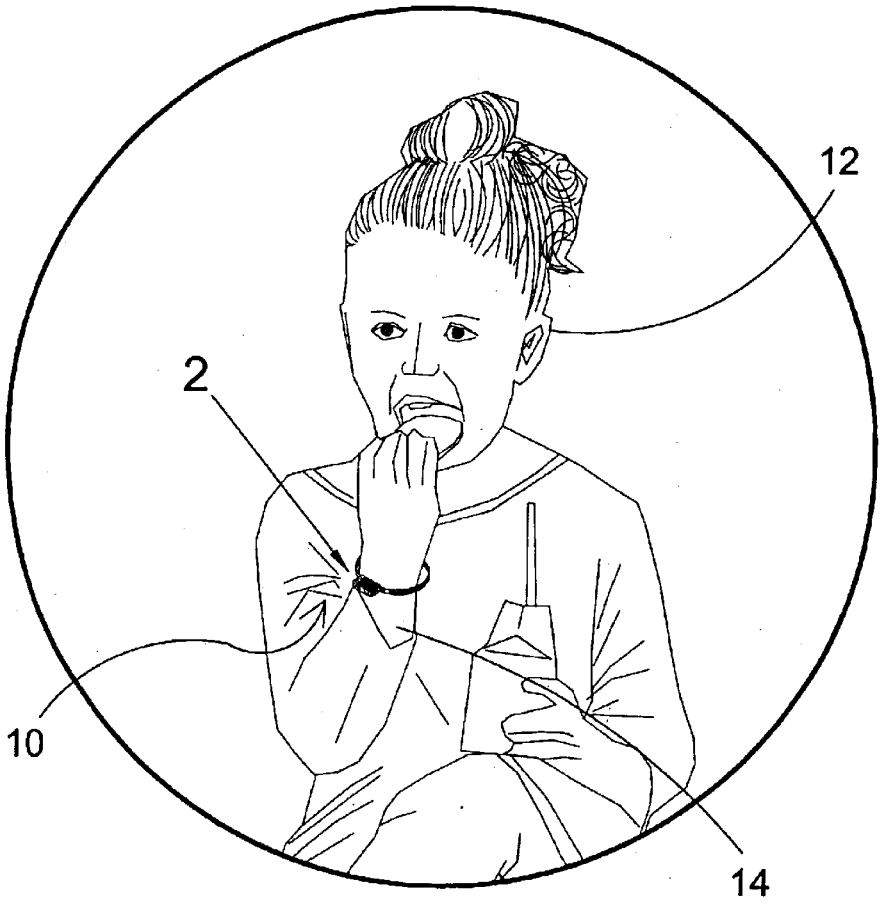
FIG. 1 is an illustrative view of the present invention in use.

With regard to reference numerals used, the following numbering is used throughout the drawings.

10 present invention
12 child
14 wrist
16 first half
18 second half
20 housing
22 door
24 toothbrush
26 hinge
28 bracelet
30 ring
32 finger
34 ring base

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments since practitioners skilled in the art will recognize numerous other embodiments as well. For a definition of the complete scope of the invention, the reader is directed to the appended claims.

Turning to FIG. 1, shown therein is an illustrative view of the present invention 10 in use. The present invention 10, a novelty bracelet designed for children 12 to wear on their wrists 14 has several advantages, dentists are constantly reminding their patients to brush after every meal. This is a difficult task for children 12 in school or away at camp. Many are embarrassed to remove a toothbrush from their knapsack and many become consumed with their activities and forget to brush. The present invention 10 overcomes these problems by providing a jewelry bracelet that incorporates a toothbrush whereby a child 12 would wear it on the wrist 14 portion of the body. The bracelet looks cool and is a great reminder to brush after each meal.

Figure 2:
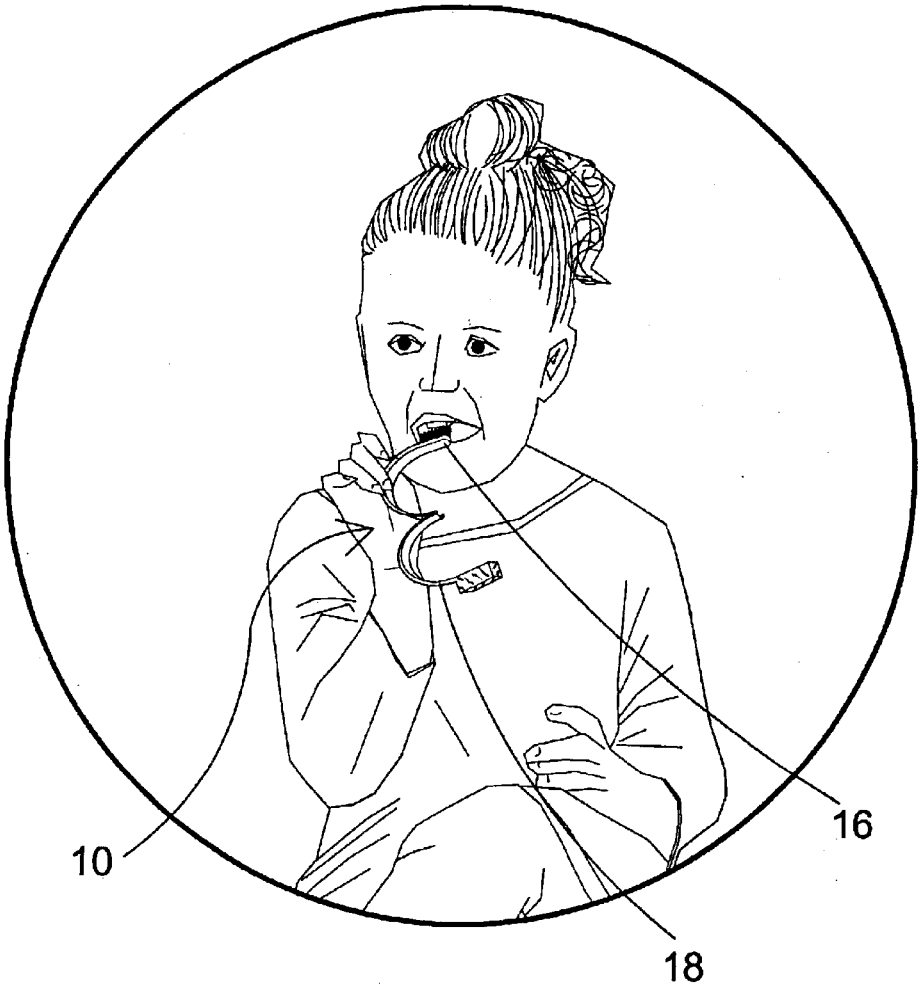
FIG. 2 is an illustrative view of the present invention in use.

Turning to FIG. 2, shown therein is an illustrative view of the present invention 10 in use. The tooth brush bracelet of the present invention 10 is a multipurpose device comprising two half, elliptical shaped members 16, 18 that are pivotally attached by a hinge member. Located at the opposite end from the hinge portion of the first half 16, comprises toothbrush member fixedly attached to the housing. Located at the opposite distal end from the hinge portion of the second half 18, a sanitary housing, comprising a chamber, whereby the brush portion of the first half 16 is housed therein when not in use. This also forms the closure of the device forming the bracelet shape.

Figure 3:
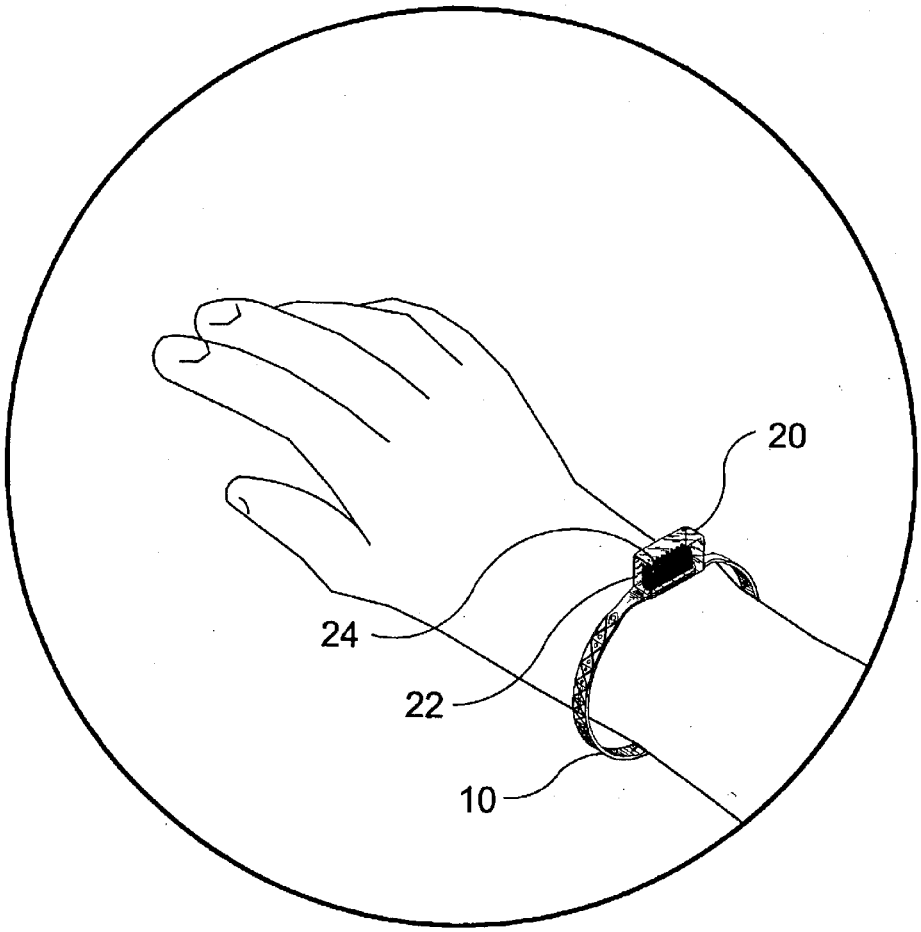
FIG. 3 is an illustrative view of the present invention in use.

Turning to FIG. 3, shown therein is an illustrative view of the present invention 10 in use. The toothbrush bracelet of the present invention 10 comprises a sanitary housing chamber 20 having a spring-loaded multipurpose door 22 that provides a sanitary seal, locking out contamination and providing closure to the toothbrush 24 portion of the device. When the device is ready to be used, the sanitary door 22 is lifted up and the toothbrush 24 portion is removed from the chamber.

Figure 4:
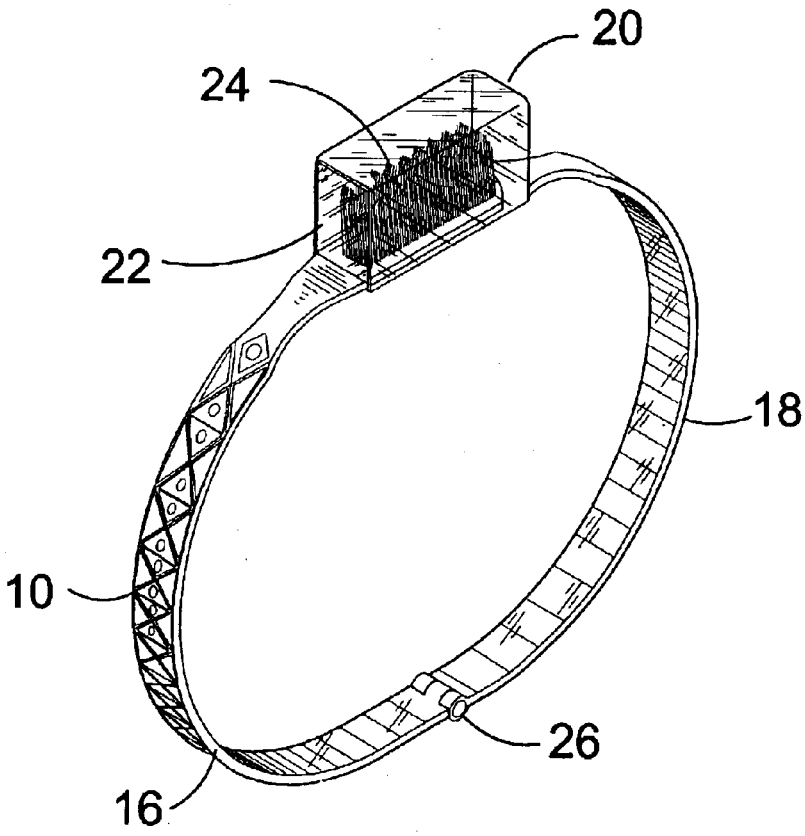
FIG. 4 is a perspective view of the present invention.

Turning to FIG. 4, shown therein is a perspective view of the present invention 10. Shown is the toothbrush bracelet of the present invention 10 being a multipurpose device comprising two half, elliptical shaped members 16, 18 that are pivotally attached by a hinge member 26 sized to be worn on the wrist of a user. Located at the opposite end from the hinge portion of the first half 16 is a toothbrush member 24 is fixedly attached to the housing. Toothbrush 24 axis runs longitudinally along the axis of the flat shaped bracelet. Located at the opposite distal end from the hinge portion of the second half 18 is a sanitary housing 20, comprising a chamber with door 22 thereon, whereby the brush portion 24 of the first half 16 is housed therein when not in use. This also forms the closure of the device forming the bracelet shape.

Figure 5:
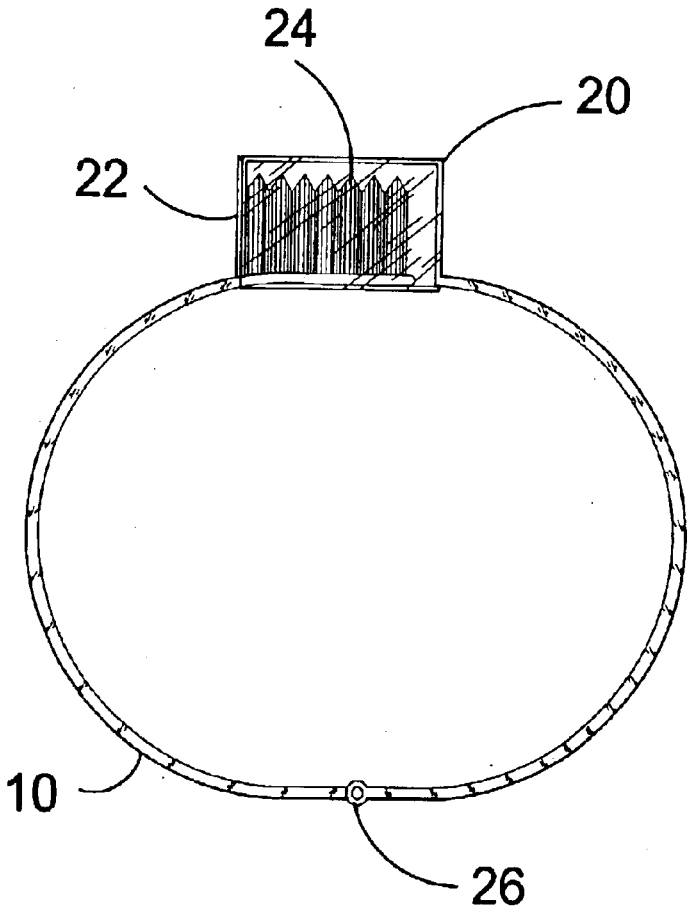
FIG. 5 is an orthographic view of the present invention.

Turning to FIG. 5, shown therein is an orthographic view of the present invention 10. Shown is the toothbrush bracelet of the present invention 10 in the closed position with the tooth brush portion 24 within the sanitary chamber 20 and the spring loaded door 22 in the closed position, keeping the toothbrush portion captive therein. Hinge 26 is also shown.

Figure 6:
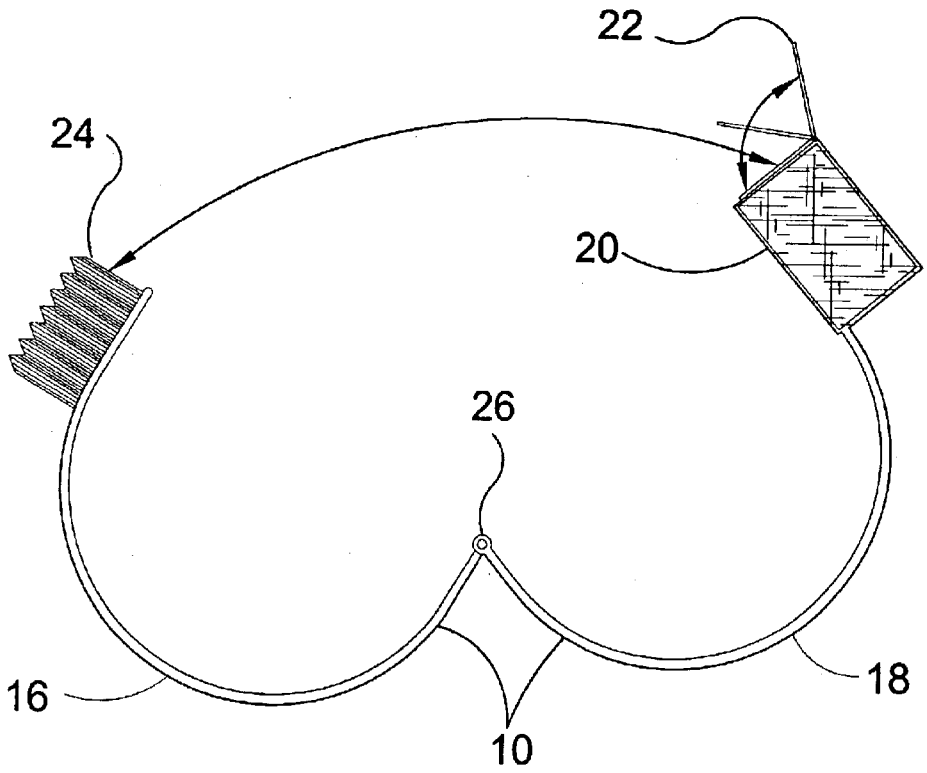
FIG. 6 is an orthographic view of the present invention.

Turning to FIG. 6, shown therein is an orthographic view of the present invention 10. Shown is the toothbrush bracelet of the present invention 10 in the open position with the toothbrush portion 24 free from the sanitary chamber 20. The hinge portion 26 of the device allows for the pivoting of the two bracelet halves 16, 18 from the closed position to an open position. Door 22 is also shown.

Figure 7:
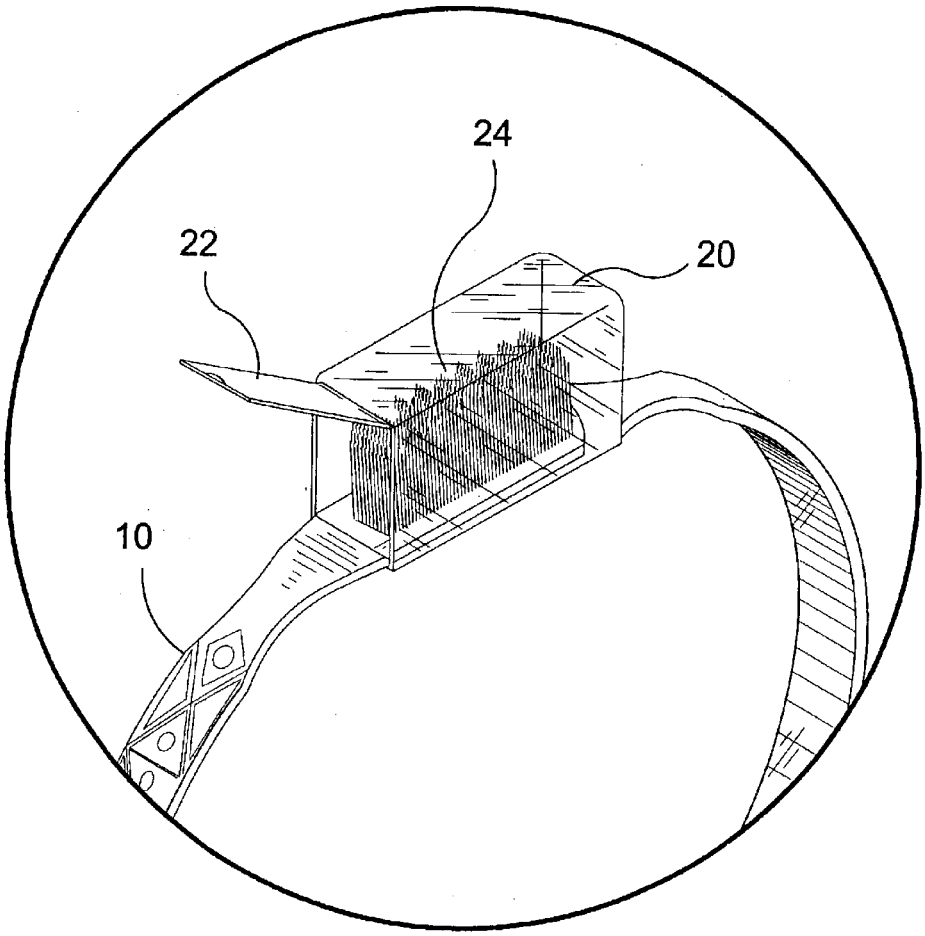
FIG. 7 is a detailed view of the present invention.

Turning to FIG. 7, shown therein is a detailed view of the present invention 10. Shown is a detailed view of the sanitary chamber 20 with the toothbrush portion 24 within the chamber and the sanitary door 22 in the open position.

Figure 8:
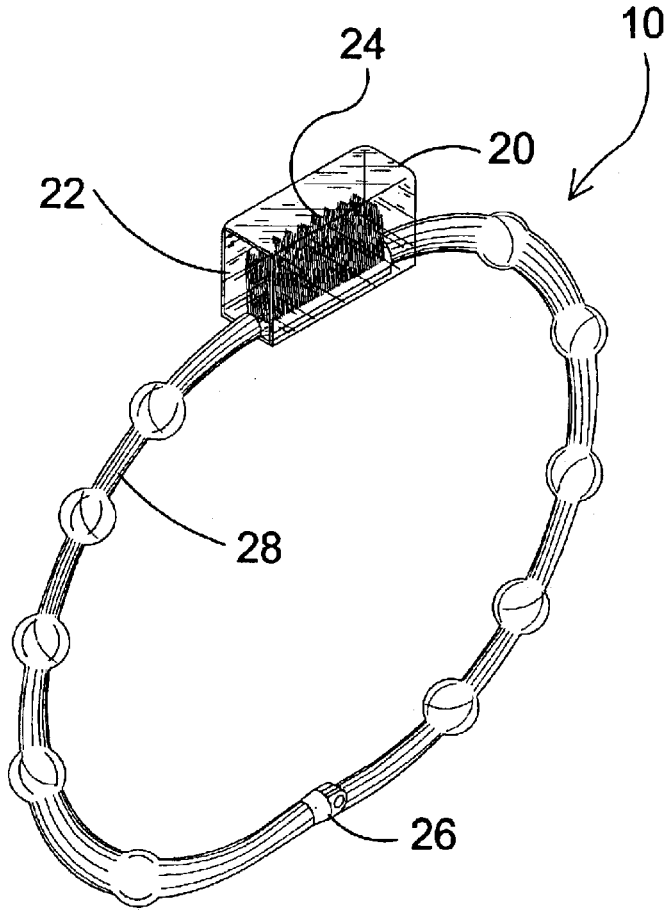
FIG. 8 is an alternate view of the present invention.

Turning to FIG. 8, shown therein is an alternate view of the present invention 10. Shown is an alternate bracelet 28 of the present invention 10 having a round shaped body. Also shown are the toothbrush 24, housing 20, door 22 and hinge 26.

Figure 9:
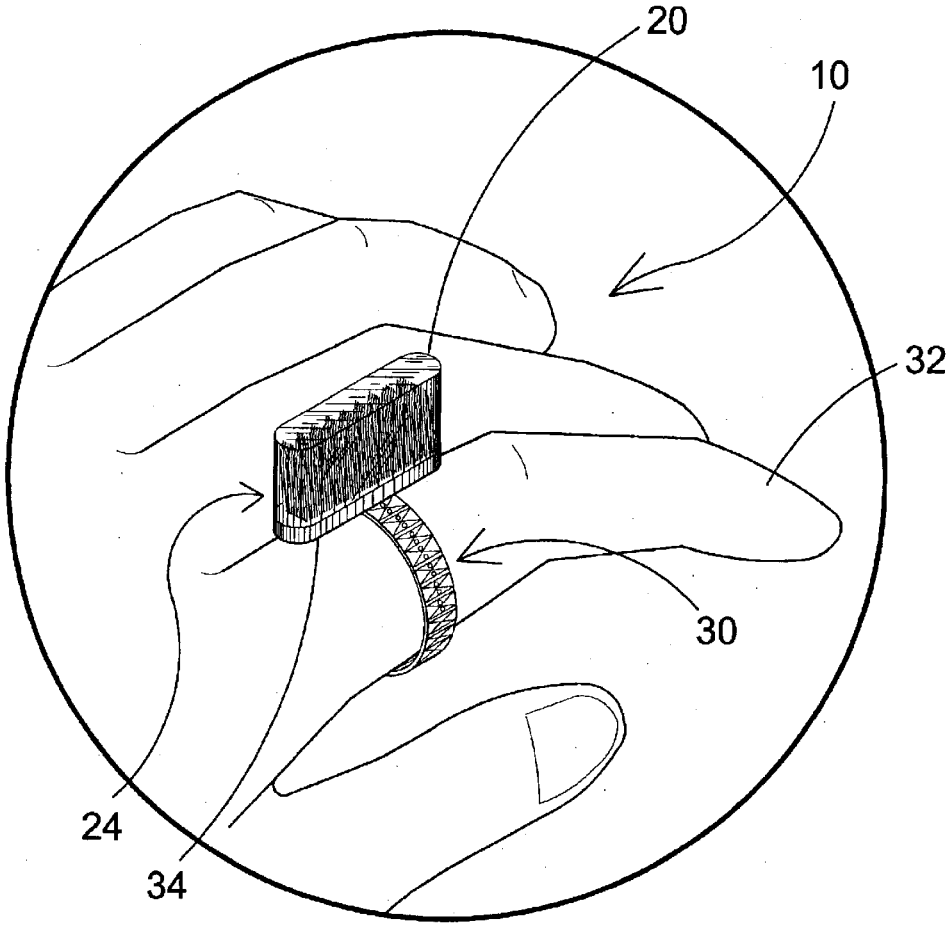
FIG. 9 is an illustrative view of an alternate of the present invention.

Turning to FIG. 9, shown therein is an illustrative view of an alternate of the present invention 10. Shown is a view of the present invention 10 in the form of a ring 30, whereby children can wear it on a finger 32 of the hand and then remove it to brush their teeth. The ring toothbrush of the present invention provides a sanitary cover or housing 20 that snaps onto the toothbrush base 34. A toothbrush 24 is disposed therein.

Figure 10:
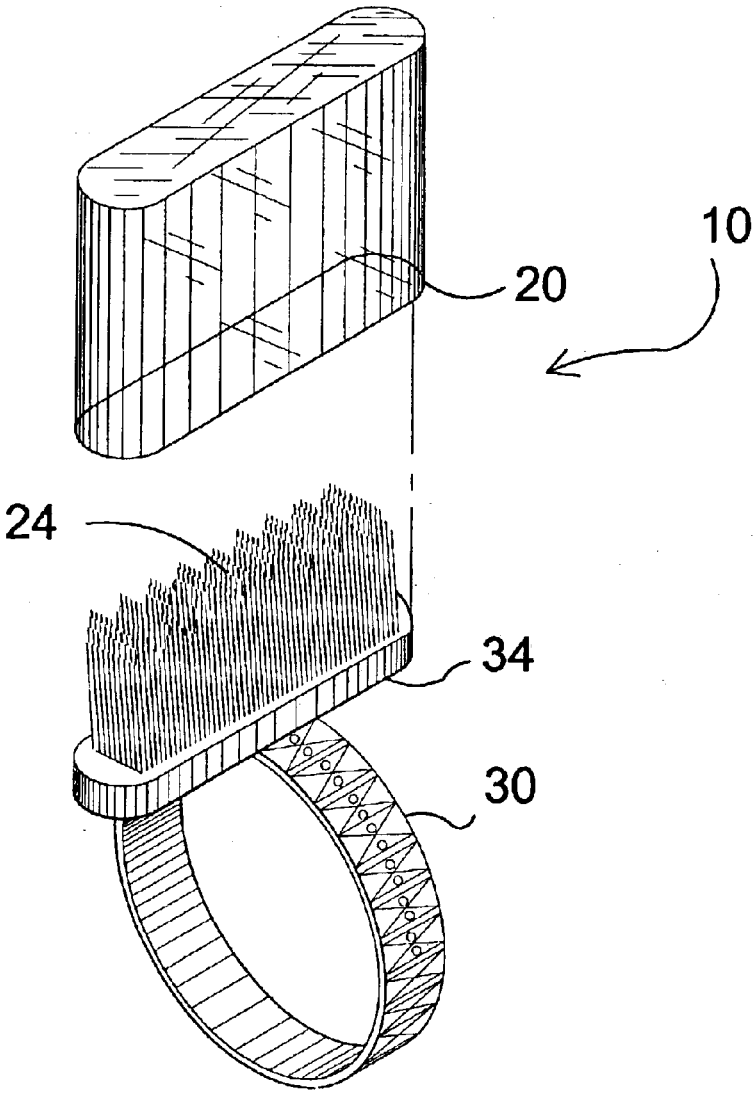
FIG. 10 is a perspective view of an alternate of the present invention.

Turning to FIG. 10, shown therein is a perspective view of an alternate of the present invention 10. Shown is a view of the present invention 10 in the form of a ring 30 sized for a finger, whereby children can wear it on a finger of the hand and then remove it to brush their teeth. The ring toothbrush of the present invention provides a sanitary cover 20 that snaps onto the toothbrush base 34. Toothbrush 24 is disposed therein so that it is perpendicular to the ring and parallel to the axis of a finger.

I claim:

1. A bracelet adapted to form a toothbrush for being worn on the wrist of a user, comprising:

a) a first and a second half of an elliptical shaped bracelet member, said first and second half each having a first and a second end to permit the first and second half to be joined together to form a bracelet to be worn by a user, b) a hinge disposed on said first end of said first and second half of a bracelet to permit the pair of halves to pivotally join;

c) a toothbrush disposed on said second end of said first half of the bracelet to permit a user to brush their teeth; and, d) a toothbrush housing disposed on said second end of said second half of a bracelet to permit the toothbrush to be hygienically protected.

2. The bracelet of claim 1, wherein said bracelet is sized to be worn on a wrist of a user.

3. The bracelet of claim 2, wherein said longitudinal axis of said toothbrush is longitudinally disposed on said axis of said first half of the bracelet.

4. The bracelet of claim 3, wherein said toothbrush housing is substantially rectangular shaped having a top, bottom, a pair of sides, and a first and second end.

5. The bracelet of claim 4, wherein said toothbrush housing is complementarily sized as the toothbrush.

6. The bracelet of claim 5, further comprising a hinged door disposed on said first end of said toothbrush housing to permit the toothbrush to enter the housing.

7. The bracelet of claim 6, further comprising a spring-loaded door being disposed on said first end of said toothbrush housing.

8. The bracelet of claim 7, wherein said door forms a seal with said first end of said toothbrush housing to hygienically protect the toothbrush.

9. The bracelet of claim 8, wherein said first and second half of said bracelet member is flat shaped.

10. The bracelet of claim 9, wherein said first and second half of said bracelet member is round shaped.

* * * * *